United States Patent [19]

Elwert et al.

[11] 4,351,435

[45] Sep. 28, 1982

[54] MAGAZINE FOR THE PROTECTED STORAGE OF A SET OF DRILLS

[75] Inventors: Wolfram Elwert, Ludwigsburg; Gernot Förster, Asperg, both of Fed. Rep. of Germany

[73] Assignee: East Tradacons AG, Steinhausen, Switzerland

[21] Appl. No.: 133,653

[22] Filed: Mar. 24, 1980

[30] Foreign Application Priority Data

Mar. 24, 1979 [DE] Fed. Rep. of Germany ..... 2911607

[51] Int. Cl.[3] ..... B65D 85/20; B65D 83/02; B65D 43/20

[52] U.S. Cl. ..... 206/379; 206/267; 206/380; 220/350

[58] Field of Search ..... 206/379, 380, 267; 220/350, 20; 312/73, 297

[56] References Cited

U.S. PATENT DOCUMENTS

| | | | |
|---|---|---|---|
| 2,078,665 | 4/1937 | Horsley | 220/350 |
| 2,351,815 | 6/1944 | Jensen | 312/73 |
| 2,412,332 | 12/1946 | Hansen | 220/20 |
| 2,650,699 | 9/1953 | Donovan | 220/350 |
| 2,812,851 | 11/1957 | Kinnebrew | 206/267 |
| 4,061,227 | 12/1977 | Olbres | 220/350 |

*Primary Examiner*—William T. Dixson, Jr.

*Attorney, Agent, or Firm*—Craig and Antonelli

[57] ABSTRACT

A magazine for a protected storage of a set of drills and for enabling a selective withdrawal of drills arranged in individual pockets in the magazine. The magazine includes a flat magazine body having narrow end faces with at least two straight rows of parallel pockets being provided in the magazine body into which drills are inserted and are accommodated over their full length. The pockets have an open end which opens in a direction of one of the narrow end faces. The narrow end faces of the magazine body are interconnected by curved transistion faces and form a sliding face for a covering strip which is slidably guided along a narrow surface area of the magazine body, which surface area is formed by the narrow end faces and the curved transistion faces. The covering strip includes a number of selector openings corresponding to the number of rows of pockets in the magazine body. The covering strip is displaced and may alternately be brought into a position giving access to the open end of a selected pocket in one row so that the selected drill can be removed therefrom. A diameter of the selector openings associated with the two rows of pockets is at least equal to a diameter of the largest drill in the respective row. A center distance of the pockets, measured in a displacement direction of the covering strip is at least equal to a clear width of the selector opening.

24 Claims, 14 Drawing Figures

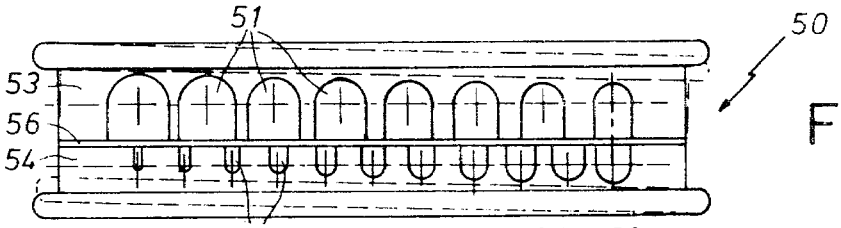
Fig.5
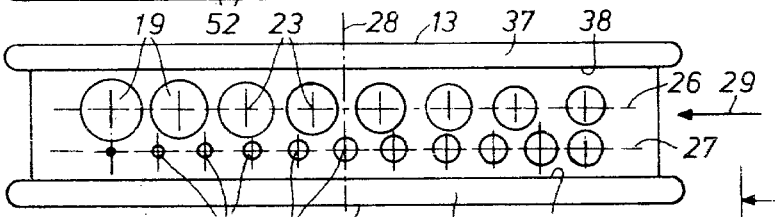
Fig.4
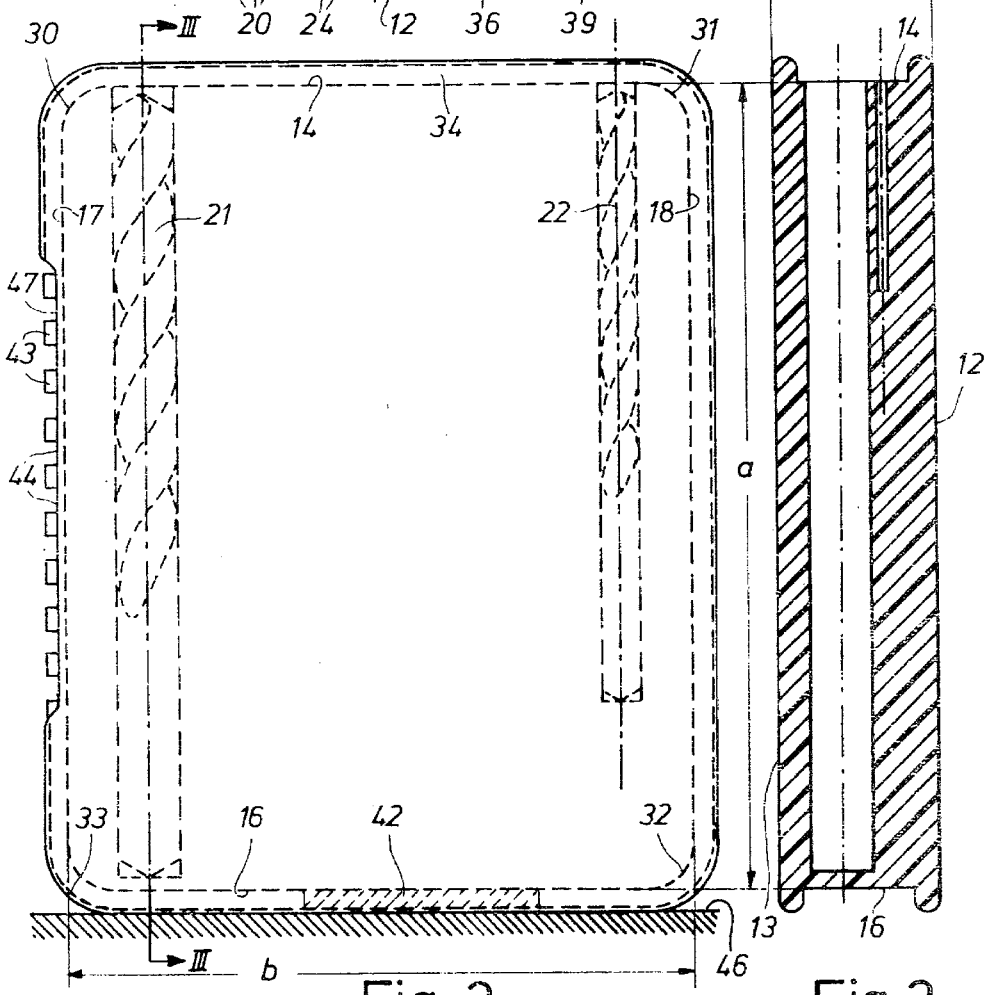
Fig. 2
Fig.3

MAGAZINE FOR THE PROTECTED STORAGE OF A SET OF DRILLS

The invention relates to a magazine for the protected storage of a set of drills and for the selective withdrawal of the drills which are arranged in individual pockets that can be closed by covering means having at least one opening which, by guided displacement of the cover means, can be moved into positions suitable for giving access to one drill at a time.

A commonly known magazine of this type comprises a straight circular cylinder having provided therein pockets which are arranged at equidistant angular distances along two circles arranged concentrically in relation to the cylinder axis, and which extend in parallel to the cylinder axis and open towards the upper end face of the cylinder. The pockets for the drills with the larger nominal diameters are arranged along one circle, for instance, the outer circle, whereas the pockets for the drills with the smaller nominal diameters are arranged along the other, for instance the inner circle. A covering and selector cap rotatably mounted on the cylinder is provided with two circular selector openings which can be brought into concentric alignment with any one of the pockets of the inner or outer circle, respectively. In the intermediate positions, i.e. when the openings coincide only partly or not at all with the individual openings of the pockets, the latter are closed.

Due to this design, the known magazine has at least the following disadvantages:

The shaping steps necessary to provide the undetachable, but still rotatable connection between the covering cap and the cylinder can be realized in plastic only with the aid of relatively expensive moulds and moulding equipment, and that of course bears heavily on the production cost. Further, it is a disadvantage of the known magazine that its cylindrical form and its relatively large diameter of approximately 7 to 8 cm make it most unsuited for so-called blister packings consisting of a plastic cover adapted to the shape of the magazine and a carton fastened thereto and provided with an opening for receiving a hanger. This proves particularly disadvantageous for storage purposes. Moreover, it is a disadvantage for the use of the known magazine that the selector positions of the covering cap associated with the larger nominal diameters and the smaller nominal diameters, which are marked along the periphery of the cylinder, are arranged very close to and between each other and that the intermediate positions of the covering cap in which the pockets should be closed, allow only extremely small tolerances so that even minor displacements of the covering cap, which cannot be avoided when the magazine is transported in a tool box, may cause individual drills to come loose and to get damaged or even be lost.

Now, it is the object of the present invention to provide a magazine of the type described above which, on the one hand, can be produced more easily and at lower cost and requires less space when stacked and which, on the other hand, provides reliable protection for the drills stored therein, while being easy and convenient to handle.

According to the invention, this object is achieved by the following features:

(a) The magazine has the shape of a flat cuboid comprising at least two straight rows of parallel pockets with one open end with drills inserted therein over their full length, the pockets opening towards one of the narrow end faces of the cuboid.

(b) The narrow end faces of the magazine body are interconnected by 90° curvatures and form a sliding face for a selector and covering strip which is slidably guided along the narrow surface area of the cuboid magazine body formed by the narrow end faces and the curved transition faces.

(c) The selector strip comprises a number of selector openings corresponding to the number of pocket rows, which by displacing the selector strip can be alternatively brought into a position giving access to the opening of a selected pocket in one row so that the selected drill can be removed therefrom, the diameter of the selector openings associated with the two rows of pockets being at least equal to the diameter of the largest drill comprised in the respective row and the centre distance of the pockets, measured in the direction of displacement, being at least equal to the clear width of the selector opening.

This design provides at least the following advantages for the use of the magazine:

In the closed position, the selector strip can be brought into a position where both selector openings are situated at a great distance from the closest pocket so that the strip is prevented with almost absolute certainty from getting "spontaneously" into a position in which a drill may unwantedly drop out of its pocket. The shape of the magazine is very well suited for accommodation in a usual tool box, and this is of particular advantage of the convenient use of such a magazine. Moreover, the magazine can be produced easily and at low cost in accordance with the usual die-casting techniques, and its shape permits also the most economical transportation and/or storage of large numbers of such magazines.

It goes without saying that the clear diameters of the pockets are adapted to the nominal diameters of the drills accommodated therein and only little larger than the latter. A usual drill set comprises for instance a number of several drills of the same type (for instance super high-speed steel), but with different nominal diameters. In this case, two or more rows of pockets are provided in the magazine, depending on the number of drills to be accommodated. Other usual drill sets comprise drills of approximately the same nominal diameters, but of different type, for instance a wood-boring drill, a stone drill, a chrome-vanadium drill for soft metals and a super high-speed steel drill, all of the same nominal diameters, and the taps matching the metal drills.

The pockets of the two rows can be alternately exposed by the displacement of the selector strip for instance by an arrangement in which the selector openings visible along one row each are arranged adjacent each other, viewed across the longitudinal direction of the strip, and in which the pockets are provided at equal distances, viewed in the longitudinal direction of the strip, and the pockets of the one row are staggered in relation to those of the other row. So, the pockets in the two rows are alternately exposed.

As compared to this arrangement, the arrangement of the selector openings described in claim 2 offers the advantage that a corresponding displacement of the strip will expose first the pockets of the one row and then the pockets of the other row.

The arrangement described in claim 3, may be improved by incorporation of the features of claim 4, provides an alternative, substantially two-piece design of the magazine body which is particularly suited for plastic die-casting.

The embodiment of the magazine in accordance with the features of claim 5 offers the advantage that the drills are easily seen, and this in turn facilitates the adjustment of the employed selector opening of the selector strip, which can be displaced about the periphery of the magazine body, to the pocket of the selected drill.

The embodiment of the magazine in accordance with the features of claim 6 offers the advantage that the selector strip can be easily displaced even with the lateral projections acting as guide for the selector strip resting on a support.

The features of claim 7 provide an embodiment of the magazine which can be extended in the most simple manner to a magazine comprising more than two pocket rows.

The handy design of the selector strip in accordance with the features of claim 8 facilitates, on the one hand, the displacement of the selector strip along the sliding surface and ensures, on the other hand, that the drills and the inner face of the strip cannot get jammed.

The additional beads in accordance with claim 9 also facilitate the adjustment of the selector openings of the selector strip to the selected pocket and may be used also in connection with marks provided on the guide ribs and/or the adjacent side faces of the magazine body for indicating the nominal diameter of the selected drill.

The feature of claim 10 provides a magazine design for exceptionally easy, and even one-hand operation.

The elastic design of the selector strip in accordance with the features of claim 11 makes the assembly of the magazine particularly easy and enables damaged selector strips to be easily exchanged, should such an exchange become necessary.

The feature of claim 12 enables the selector strip to be locked by friction in the position into which it has been brought for instance for the purpose of closing the pockets.

The arrangement of claim 13 in which the covering strip is divided into two strands which can be reduced and extended in length by altogether the full length of the necessary displacement of the selector opening and in which the selector element is arranged between the two strands and the ends of the strands opposite the said selector element are fixed at those two opposite end faces of the magazine which extend vertically to the end face provided with the pocket openings, reduces the wear of the covering strip noticeably and ensures that the covering strip will easily slide even after extended use.

These are at least the advantages derived from this arrangement in use:

The folding covering strip is always and in every position only in loose contact with the covered end faces of the magazine body so that any dirt particles that may get between the strip and the said surfaces will never be firmly pressed against the sliding faces, and this in turn will help to prevent damage to the latter and/or to the strip and the detrimental effects on the sliding properties of the strip and the selector element resulting therefrom. Another advantage lies in the fact that the strip surrounds only part of the magazine so that at least the narrow end face of the magazine opposite the pocket holes is not covered by the strip. This latter magazine face may therefore be used as a base for placing the magazine on a support, and there does not exist the risk that any dirt particles present on the support will get into contact, with and damage the covering strip. When the strand ends are designed in a suitable manner, the covering strip and the selector element may moreover be easily removed, whereby cleaning of the magazine is rendered particularly easy, should it occasionally become necessary.

An additional advantage lies in the shorter travel of the selector opening which is maximally equal to the length of one pocket row.

The features of claim 14 ensure that the covering strip is over its whole length in loose contact with the sliding guide faces and that nevertheless the undulated element and the strip are guided with sufficient precision.

In the arrangement according to the features of claim 15, it is a particular characteristic of the covering strip that its elastic force which counteracts any selection movement rises as the selector element is moved farther away from its rest position in which the two strands of the covering strip exhibit no tension at all or the same elastic tension. By giving the selector strip a suitable length and a suitable symmetric arrangement of its strands, this property of the selector strip may be advantageously used for causing the selector member to return automatically from any selected position into its rest position in which all pockets are closed.

The features of claim 16, in combination with those of claim 17 if desired, provide a design of the covering strip of the magazine which favors the defined formation of the folds in the covering strip during the selction movement as well as its easy and low-cost production by plastic moulding processes.

The features of claim 18 provide an arrangement of the pockets and a design of the selector element which ensure with particular reliability that when the selector element occupies a position in which a selected drill can be removed from its pocket, the neighboring pockets, both in the longitudinal and in the crosswise direction, are safely closed.

The design of the selector element and the magazine body characterized by the features of claim 19 and defined in still greater detail by the features of claim 20 for a special case of particular importance in practical use is particularly space-saving and, accordingly, particularly advantageous, both as regards its handling and as regards the low-cost production of the magazine.

Other details and features of the invention will be apparent from the following description of examples of the invention with reference to the drawing, in which:

FIG. 2 shows a side elevation of the magazine of FIG. 1, in natural scale;

FIG. 3 shows a section along line III—III in FIG. 2,

FIG. 4 shows a view of the side of the magazine of FIG. 1 provided with the pocket openings for the drills, with the selector strip removed, likewise in natural scale;

FIG. 5 shows a view identical to that of FIG. 4 of an alternative substantially two-piece design of the magazine body;

Figure 1:
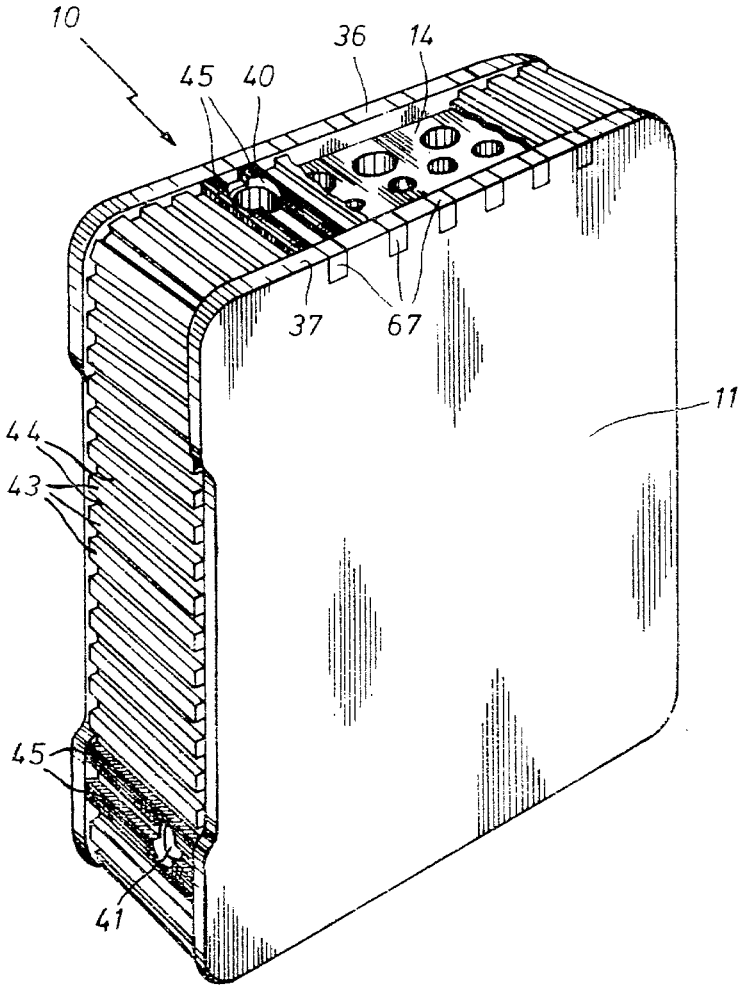
FIG. 1 shows a perspective general view of a drill magazine in accordance with the invention, approximately in natural scale.

A magazine generally designated by the reference numeral 10, shown in all its details in FIGS. 1 to 4 is designed for receiving a set of a total of 19 spiral drills of standardized size, the nominal diameters of which vary between 1 mm and 10 mm, graded by 0.5 mm steps.

The magazine 10 comprises a substantially cuboid main body 11 with broad side faces 12 and 13 and narrow end faces 14, 16 and 17, 18. The broad side faces have a width-to-height ratio of a/b=approximately 4/3, the height a, which is approx. 140 mm, being a little greater than the length of the largest drill which has a nominal diameter of 10 mm. The width-to-length ratio c/a of the narrow end faces 14, 16 and 17, 18 is approximately equal to 1/5, wherein c is the width measured vertically to the side faces 11 and 12 and a is the greatest length.

In the arrangement shown in FIG. 4, to which express reference is herewith made, the narrow end face 14 of the cuboid main body 11, which is the upper face in FIGS. 3 and 4 and of which a plan view is shown in FIG. 4, is provided with the openings of pockets 19 and 20 in which drills are inserted over their full length. FIG. 2 shows by way of example a drill 21 having the largest nominal diameter of 10 mm and a length of approximately 132 mm and a drill 22 having a medium nominal diameter of 6.5 mm and a length of approximately 100 mm. In the particular embodiment shown in FIGS. 2 to 4, the pockets 19 and 20 take the form of blind holes or circular recesses, the axes 23/24 of which extend vertically to the upper end face 14 and in two planes 26/27 parallel to the side faces 12/13. The one plane 26 unites in itself in symmetrical arrangement in relation to the transverse center plane 28 of the cuboid main body 11 the axes 23 of a total of 8 of the pockets 19 provided for the accommodation of the drills having the larger nominal diameters of between 6.5 and 10 mm, whereas, the other plane 27 unites in itself, likewise in symmetrical arrangement in relation to the transverse center plane 28, the axes 24 of the 11 pockets 20 intended for the drills having the smaller nominal diameters of between 1 mm and 6 mm. The depth of the pockets 19 and 20, measured from the upper end face 14, is always a little (approximately 0.2 to 0.5 mm) larger than the length of the drills to be accommodated in the individual pockets, and the clear diameter of the pockets 19 and 20 is approximately 0.2 to 0.5 mm larger than the nominal diameter of the associated drill.

Viewed in the direction indicated by the arrow 29 in FIG. 4, the pockets 19 for the larger drills are arranged at equal center distances of approximately 11.5 mm in the order of increasing nominal diameters, while the pockets 20 are arranged at equal center distances of 8 mm in the order of decreasing nominal diameters. The lateral distance between the two planes of the axes 26 and 27 is 7 mm, the distance between the one plane 26 uniting in itself the axes of the "larger" pockets 19, and its neighboring side face 13 is 11 mm, and the distance between the other plane of axes 27 and its neighboring side face 12 is 9 mm.

The narrow end faces 14, 16, 17, 18, which are smoothly interconnected by curved 90° transition pieces 30–33 having a radius of curvature of approx. 8 mm, form the sliding face for a flexible covering selector strip 34 which is in full contact with the outer face of the magazine body 11 formed by the narrow end faces 14 and 16–18 and the connecting faces 30–33. The flexible covering selector strip 34 can be displaced along the said sliding face and is guided during its movements by guide ribs 36 and 37 projecting on both sides from the edges of the sliding face.

The guide ribs 36 and 37 have a height of approx. 4 mm, measured from the sliding face, and a width at their base of likewise 4 mm. Their outer walls are flush with the side faces 12 and 13 of the main body 11. The distance between their opposite inner faces 38 and 39 which provide the guidance for the strip corresponds to the width of the selector strip 34. The selector strips has two preferably circular selector openings 40 and 41 (FIG. 1) which, by suitable displacement of the selector strip 34, can be brought into concentric alignment with the openings of the individual pockets 19/20, for removal of a selected drill from the magazine 11, through the selector opening 40/41. The arrangement of the one selector opening 40 is such that when the selector strip is displaced, its center moves along the plane 26 uniting in itself the axes 23 of the pockets 19 for the larger drills. Its diameter is only little, i.e. by maximally ½ mm, larger than the diameter of the largest drill 21. The other selector opening 41 moves, when the strip is displaced, along the plane 27 uniting in itself the axes 24 of the pockets 20 for the smaller drills. Its diameter is also only little larger than the largest nominal diameter (6 mm) of the drills contained in these pockets 20. Viewed in the longitudinal direction of the selector strip 34, the distance between the two selector openings 40 and 41 is such that the two selector openings 40 and 41 cannot simultaneously be brought into a position in relation to one each of the pockets 19 or 20 suitable for the removal of the drill accommodated therein. The distance between the selector openings 40 and 41 is conveniently selected to ensure that, provided a given direction of displacement, the selector strip 34 must be displaced by a travel corresponding approximately to the center distance of the pockets 19 or the pockets 20 in order to bring the selector opening 41 into its first position suitable for the removal of a drill when the other selector opening 40 was previously in its last position suited for the removal of a drill. In the case of the magazine 10 shown in FIGS. 1 to 4, this distance is approximately 10 cm.

The selector strip 34 preferably takes the form of a closed strip sufficiently elastic to be moved over the guide ribs 36 or 37 into the position in which it surrounds the main body 11 and is in contact with the sliding face. The elasticity of the strip 34 required for this purpose can be achieved also by providing, in the strip 34 of the arrangement shown in FIG. 2, a rubber-elastic section 42 of a few centimeters' length, while the rest of the selector strip is substantially inelastic. The selector strip 34 is preferably made from a thermoplastic synthetic material, preferably polypropylene (PP). Its inner face, i.e. the face which is in contact with the sliding surface, is smooth while its outer face is provided with grip ribs 43 having a substantially rectangular cross-section and extending vertically in relation to the direction of displacement, so that the strip as a whole resembles a roller shutter with "slats" formed by the grip ribs 43 and extending vertically to the direction of displacement and film joints 44 of reduced material thickness arranged therebetween which impart to the selector strip the necessary flexibility. The material thickness of the said film joints 44 is between 0.5 and 1 mm. Measured in the longitudinal direction of the selector strip 34, the film joints 44 and the grip ribs 43 have a substantially equal width of 3 to 4 mm. The material thickness of the selector strip 34 in the area of its grip ribs is approximately 3 to 4 mm. This is little less than the height of the guide ribs 36 and 37, so that the selector strip 34 will easily slide even when the magazine 10 rests on a support 46.

One narrow side 17 of the magazine 10 is provided with an area 47 extending over approximately $\frac{2}{3}$ of its length where the guide ribs 36 and 37 are a little lower than the grip ribs 43. This enables the selector strip 34 to be easily displaced with one hand only. To this end, the user grips the magazine 10 around the opposite narrow side 18 and displaces the selector strip 34 in the area 47 of reduced guide rib height, by means of his thumb.

Beads 45 which are arranged on both sides of the selector openings 40/41 and which in the embodiment shown in FIG. 1 take the form of reinforced grip ribs, serve on the one hand to make the position of the selector openings 40 and 41 better visible and, on the other hand, to facilitate the displacement of the selector strip 34, in particular if the rest of the latter is smooth. Moreover, the beads 40 may advantageously be used, in connection with the diameter marks 67 provided on the guide ribs 36 and 37, to make the selected position better discernable.

Figure 6:
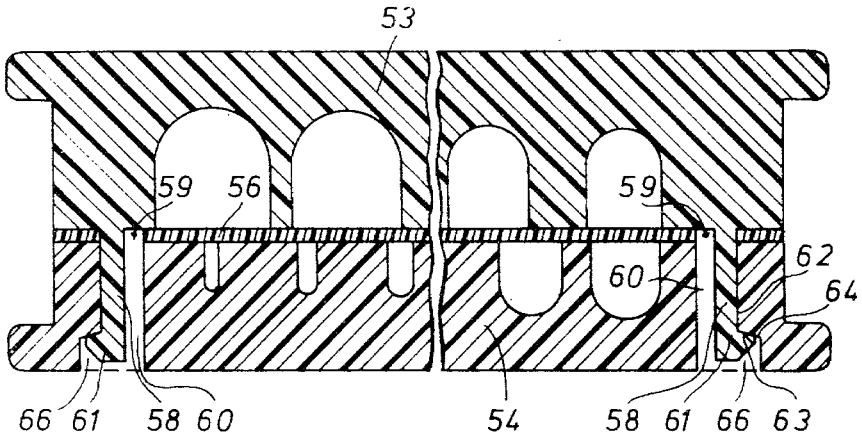
FIG. 6 shows details of snap-in connections for assembling the individual parts of the magazine body of FIG. 5, in enlarged scale.
Figure 7:
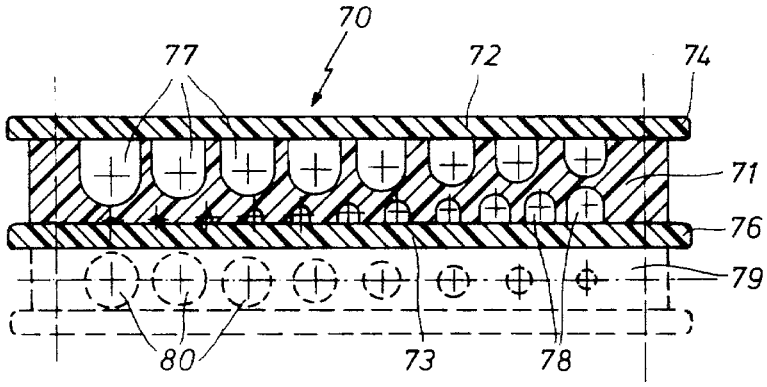
FIG. 7 shows a section along a line extending vertically to the axes of the pockets, through another embodiment of a magazine in accordance with the invention.

The magazine 10 described above has its magazine body 11 and the guide ribs 36 and 37 designed as one piece and made, for instance, from acrylic glass or a thermosetting plastic suited for die-casting and curing such as polyethylene. Or else, the magazine body 11 may also be designed as a two-piece or three-piece body, as shown in FIGS. 5, 6 and 7 to which express reference is herewith made. Such a design offers advantages both for the production and for the assembly and initial charging of the magazine with drills:

The main difference of a magazine generally designated by the reference numeral 50 in FIG. 5 over the magazine 10 shown in FIGS. 2 to 4 lies in the design of its pockets 51 and 52 for the drills with the larger and smaller nominal diameters, respectively. Here, these pockets 51, 52 take the form of recessed grooves of U-shaped cross-section provided in the sides of the plate-shaped partial magazine bodies 53 and 54 facing each other and separated by a film or thin plate 56 arranged between the partial bodies 53 and 54 or rather between their grooves 51 and 52.

When, as shown in FIG. 5, the partition wall 56 extends in parallel to the side faces 12 and 13 of the magazine body thus assembled, the pockets 51 and 52 of both rows may be arranged in the order of increasing or decreasing nominal diameters. In this case, the minimum width of the guide surface required between the guide ribs 36 and 37, not counting the film thickness of the partition wall, is determined by the sum of the diameters of the largest drills in each of the two pocket rows 51 and 52. In the particular example described herein, this minimum thickness is 16 mm. However, when the partial bodies 53 and 54 are given a wedge-like shape as indicated by the dashed line in FIG. 5 and when the pockets 51 and 52 are arranged in the one row in the order of decreasing nominal diameters and in the other row in the order of increasing nominal diameters, the said minimum width is equal to the largest value obtained by adding the nominal diameter of the largest drill of one pocket group to the nominal diameter of the smallest drill of the other pocket group, and vice versa. In the example described herein a minimum value of 12.5 mm is obtained in this case. The possibilities of saving material by such a design of the magazine body may of course be utilized also for a one-piece magazine body, as can be seen best in FIGS. 2 to 4.

The solid connection of the partial bodies 53 and 54 and the separating film or plate 56 may be achieved by screws passing through aligned openings provided in these parts in the corner areas of the magazine body 50. The two partial bodies 53 and 54 may be connected with each other or with the partition wall 56 also by bonding or welding. Rapid assembly of the magazine is also possible by means of positively engaging detent means or plug connections 57 designed in accordance with FIG. 6 which shows a pair of such plug connections. The one partial body 53 is provided with projections taking the form of resilient lugs which can be inserted through openings 59 in the partition wall 56 and into full-width slots 60 in the opposite partial body 54. The sides of the free ends of the said resilient lugs 58 facing away from each other are provided with projecting detent edges 61 of substantially trapezoidal cross-section. The inner faces of such projections 61 extend at an obtuse angle of approximately 120° in relation to the adjacent lug faces 62. In the assembled condition, these inner faces are in engagement with a correspondingly inclined shoulder face 64 of an outer enlargement 66 of the slots 60. The outer inclined faces 67 of the projections 61 facilitate the insertion of the resilient lug 58 into the slots 60, the clear width of which is sufficiently large to enable the lugs, which during the insertion will resiliently deflect, into their engaged position. Due to the inclination of the inner inclined faces of the detent edges 61 and the inclined faces 64 of the slot enlargements 66 engaged thereby, the two partial bodies 53 and 54 are drawn against each other as soon as the detent edges 61 enter the enlargement 66 of the slots 60, so that a firm connection between the partial bodies 53 and 54 is achieved even in the case of slightly different thicknesses of the partition wall 56.

Finally, FIG. 7 shows a magazine generally designated by the reference numeral 70 comprising a massive plate-like medium part 71 with flat plate-shaped side pieces 72 and 73 connected thereto. The edges 74/76 projecting over the narrow end faces of the medium part 71 form the guide ribs for a selector strip (not shown) in FIG. 7. The magazine 70 is likewise provided with two rows of pockets 77/78 for the larger and smaller drills of a super high-speed steel drill set, the pockets 77 and 78 being again provided in the particularly space-saving arrangement described in connection with the magazine shown in FIG. 5. Here again, the pockets for the drills take the form of recessed grooves with U-shaped cross-section. These grooves are provided in the opposite sides of the medium part 71 and closed to the outside by the side pieces 72 and 73. The two-row magazine of this type may be extended to comprise two or more rows by attaching to the side piece 76 another magazine body 79 in the manner indicated by the dashed line. The pockets 80 of this additional magazine body 79 may for instance contain the usual taps M3–M10 for use in connection with the super high-speed steel drills contained in the pockets of the first magazine body. The design of such an extended magazine 70 shown in FIG. 7 requires the use of two selector strips. However, it is also imaginable to assemble the additional magazine body 79 directly to the medium part 71 and to use only a single selector strip having three suitably staggered selector openings. The simple shape of the individual parts of the magazine 70 enables them to be produced most economically.

The designs of the magazine of the invention described above are particularly suited for production by plastic die-casting processes or light-metal die-casting processes.

Of course one could also imagine designs of the magazine in which the magazine body is at least partly made from suitably punched, bent, folded and, if desired, embossed sheets connected by spot welds. In this case, the pockets may for instance be defined by sheet-metal strips in the form of corrugated sheets arranged between two side walls provided with display windows. The selector strip, too, may take the form of a roller shutter assembled from rigid sheet-metal slats connected by suitable articulations.

In the further embodiments of a magazine generally designated by the reference numeral 110 of the in FIGS. 8 to 14, the design of the magazine body 11 is substantially analogous to that of the magazine 10 shown in FIGS. 1 to 4. In so far, the same reference numbers have been used hereafter to describe identical parts.

Figures 8, 9:
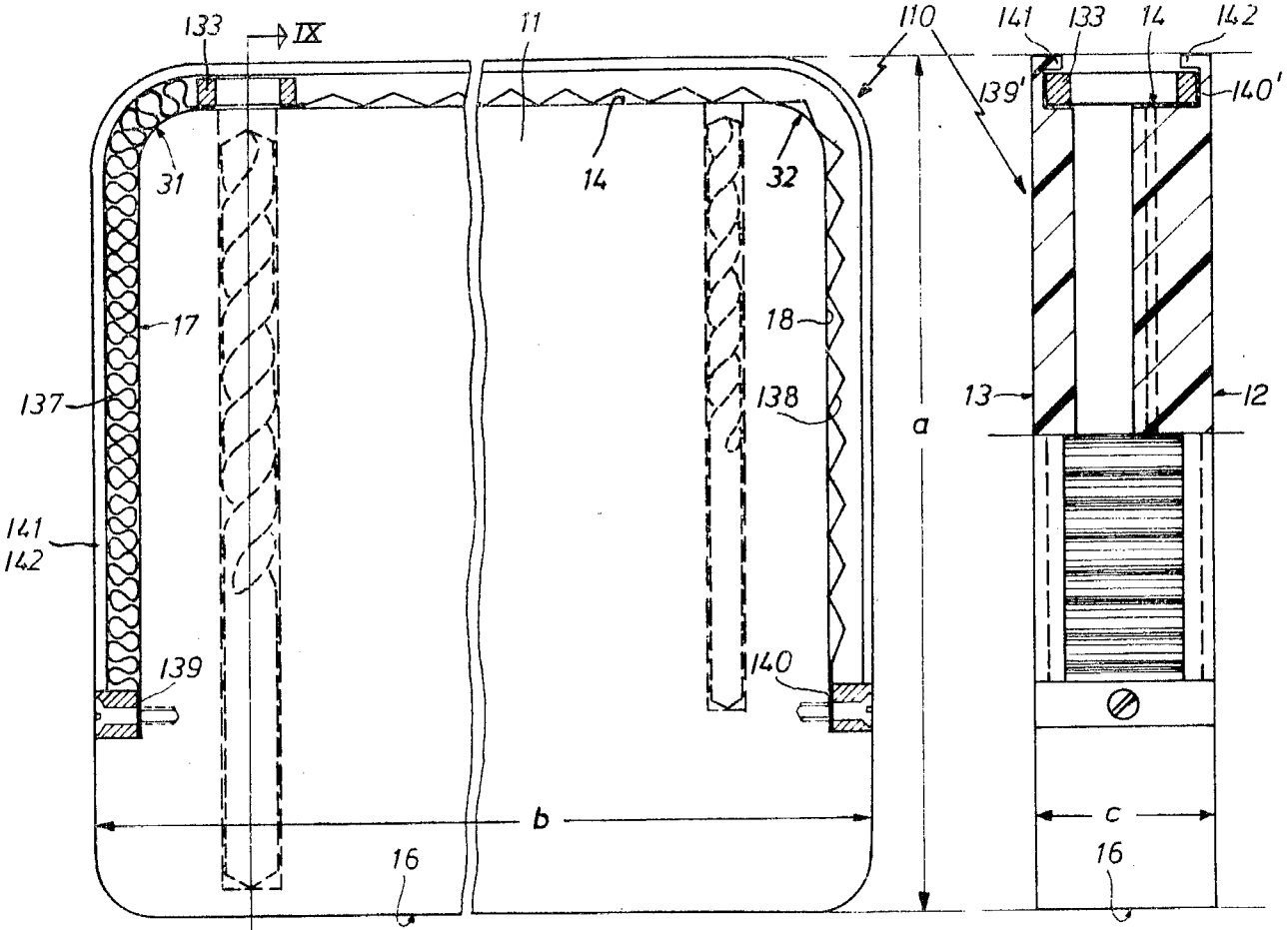
FIG. 8 shows a side elevation of another embodiment of the magazine of the invention, approximately in natural scale, with the sides of the guiding groove for a two-piece covering strip and a selector member being partly broken away at the side facing the viewer.
FIG. 9 shows a view of the narrow side of the magazine of FIG. 8, partly cut along line IX—IX in FIG. 8.
Figure 10:
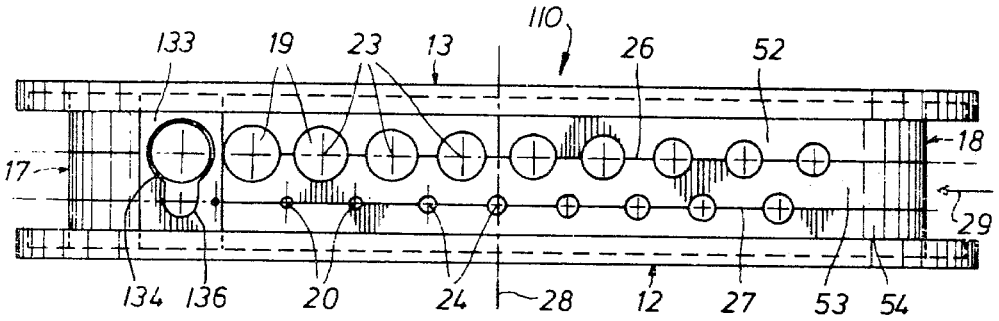
FIG. 10 shows a top view of a special arrangement of the pockets of a magazine in accordance with the invention, with the covering strip removed.

The magazine 110 of the invention shown in FIGS. 8 to 10, to which express reference is herewith made, is also especially designed for the accommodation of a set of a total of 19 spiral drills of standardized size with nominal diameters varying between 1 mm and 10 mm, graded at 0.5 mm steps.

The one plane 26 unites in itself in symmetrical arrangement in relation to the transverse center plane 28 of the cuboid main body extending vertically to the side faces 12 and 13, the axes of a total of 10 pockets 19 intended for the drills with the larger nominal diameters between 10 mm and 5.5 mm. The other plane 27 unites in itself, likewise in symmetrical arrangement in relation to the transverse center plane 28, the axes 24 of 9 of the pockets 20 intended for the drills with the smaller nominal diameters between 1 mm and 5 mm, the axes 24 of the pockets 20 being staggered in relation to the axes 23 of the pockets 19. The center distance is the same in both rows and approx. 12 mm.

The lateral distance between the two planes of the axes 26 and 27 is 7 mm in the particular embodiment described. The distance of the plane of the axes 26 of the "larger" pockets 19 and its neighboring side face 13 is 12 mm, while the distance between the other plane of axes 27 and its neighboring side face 12 is 10 mm.

A rectangular plate-shaped selector element 133 is arranged for sliding displacement on the upper, in FIG. 8, narrow end face 14. This selector element 133 is provided with selector openings 134 and 136 arranged side by side and associated with one each of the rows of pockets 19 and 20. By suitable displacement of the selector member 133, the selector openings 134 and 136 can be brought into concentric alignment with the openings of the individual pockets 19 and 20, in which position a selected drill can be withdrawn from the magazine 110 through the selector opening 34 or 36. In order to facilitate the displacement, the selector element 133 is preferably provided at its surface with a flat concave depression, or else raised grip ribs are provided along its end extending vertically to the direction of displacement. The diameters of the two selector openings are slightly, i.e. by approximately $\frac{1}{2}$ mm, larger than the diameters of the largest pocket 19 or 20 in their respective row. Viewed in the direction of displacement of the selector element 133, the latter is arranged between two strands 137 and 138 of a covering strip. In the arrangement shown in FIGS. 8–10, these strands 137 and 138 have their ends 139 and 140 opposite the selector element 133 fixed at the narrow end faces 17, 18 of the magazine body 11, at a distance from the curved transition faces 31, 32 corresponding substantially to $\frac{2}{3}$ of the side length a. For the rest, the two strands 137 and 138 of the covering strip, which take the form of folded or corrugated strips that can be extended or reduced in length similar to a bellows, are only in loose contact with the end faces 14, 17 and 18.

The selector element 133 and the strands 137 and 138 of the covering strip are guided between guide ribs 139' and 140' projecting on both sides from the edges of the end faces 14, 17 and 18. Each of the said guide ribs 139' and 140' comprises a narrow lateral flange 141, 142 overlapping an edge portion of approximately 3 mm width of the selector element 133 and the strands 137 and 138 of the selector strip, thus preventing the selector strip from loosing its contact with the sliding face.

In the embodiment shown in FIGS. 8–10, the clear distance between the lateral flanges 141 and 142 and the end faces 14, 17 and 18 is approximately 8 mm, but, depending on the particular properties of the covering strip used, it may of course also be slightly larger or smaller.

Figure 13:
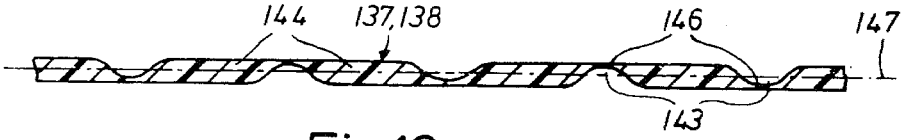
FIGS. 13 and 14 show a special form of the covering strip, namely a plastic folding strip, for use in a magazine in accordance with the invention, in the extended and folded condition.
Figure 14:
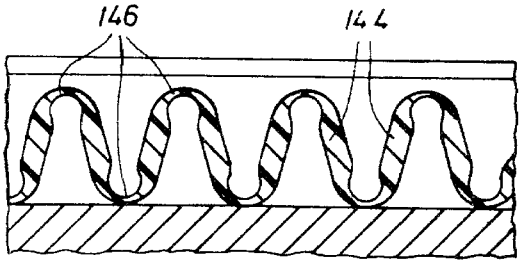

A suitable design of one or both strands 137 and 138 of the covering strip in the form of a plastic folding strip is shown in FIGS. 13 and 14, in the extended and in the folded conditions, respectively. In this design, the covering strip takes the form of a plastic strip, for instance of soft PVC or polyethylene, having a thickness of approximately 1.5 to 2 mm and a width corresponding to the clear distance between the guide ribs 139' and 140'. Crosswise extending grooves 143 provided alternately in its upper and lower faces divide the strip into segmental slats 144, the longitudinal section of which exhibits the shape of a flat parallelogram shown in FIG. 13. Film joints 146 impart to the strip its folding properties. The distance between neighbouring film joints 146, measured in the longitudinal direction of the strip, is approximately 9 mm, the length l of the segmental slats 144, measured along the longitudinal center plane 147 in FIG. 13 is 6 mm. As is apparent from FIG. 14, the folding strip 143, 144 designed in this manner can be folded to a very compact package so that such a folding strip 143, 144, which in the extended condition has a length of say 250 mm may be reduced to a length of approximately 80 mm in the folded condition. In the case of the given length-to-width ratio a/b of the magazine body 11, the length of the lateral end faces 17 and 18 is therefore amply sufficient to accommodate the folded strands 137 and 138 of the covering strip which can be extended or reduced in length by the length of the upper end face 14.

The same applies also to the design of a strand 137 of a covering strip shown in the left portion of FIG. 8. The longitudinal section of this strand 137 shows an evenly curved meander-shaped strip which can be moved to and fro between the end face 17 and the lateral flanges 141/142 of the oppositely arranged guide ribs 139', 140'. In this embodiment, the covering strip should advantageously consist of a thin-walled springy material and the design of the two strands 137/138 should be such that the rest position of the one strand, for instance the strand 137 is the position in which it is reduced to its smallest length whereas the rest position of the other strand is that in which it is extended to its greatest length. In the meaning of the last sentence, rest position should be understood to be the position in which the strand is under the least possible tension. The selector element 133 arranged between the two strands 137 and 138 will then automatically return from any selected position into which it had been brought by extension of the one strand 137 and folding together of the other strand 138, into a rest position selected to ensure that in this position all pockets 19 and 20 are covered.

When the pockets 19 and 20 are arranged in accordance with FIG. 10, such a fully-closed position is given when the selctor element 133 is displaced by 2 to 3 mm to the left from its selected position above the pocket of the largest drill 21, so that the drill 21 can no longer drop out through the selector opening 134. In the design shown in FIG. 10, where the pockets 19 and 20 are arranged at equal distances and where the selector element 133 comprises two interconnected selector openings 134 and 136 the inner widths of which correspond to the largest pocket of their associated rows of pockets 19/20, there does not exist any position of the selector element 133 in which two drills can be simultaneously removed from their respective pockets 19/20. Moreover, a relatively slight displacement of the selector element 133 from the position shown in the said drawing will suffice to safely close all pockets 19 and 20. However, this design of the magazine 110 and its selector element 133 which is particularly advantageous as regards its handling and construction, requires a relatively great length of the magazine body 11, viewed in the direction of displacement of the selector element 133.

Figure 11:
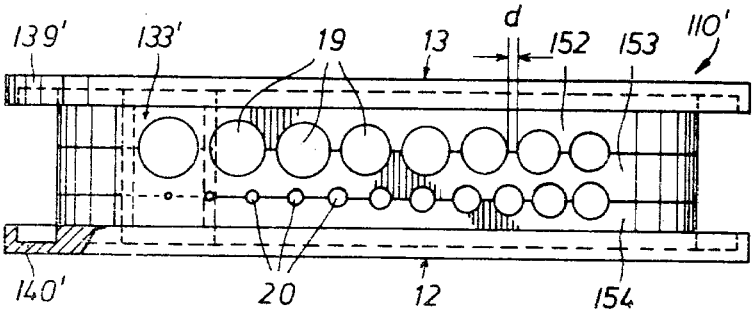
FIG. 11 shows a view similar to that of FIG. 3 of another pocket arrangement which is possible in combination with a special design of the selector element.
Figure 12:
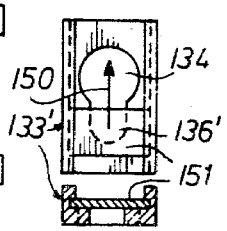
FIG. 12 shows details of the selector element shown in FIG. 8.

As compared to this, a magazine generally designated by the reference numeral 110' in accordance with the invention having the pockets 19 and 20 arranged in the manner shown in FIG. 11 and the selector element 133' designed in the manner shown in FIG. 12 offers the advantage of noticeably improved compactness.

The savings of material as compared to the design of FIG. 10, with the magazine body 11 analogously designed, amounts to more than 20%.

In the magazine 110' shown in FIG. 11, to which express reference is herewith made, the 8 pockets 19 for the larger drills with the nominal diameters between 10 mm and 6.5 mm are arranged in one pocket row, whereas, the pockets 20 for the 11 drills with the nominal diameters between 1 mm and 6 mm are arranged in the other pocket row. In the pocket row 19 for the larger drills, the center distance of neighboring pockets 19 is equal to the sum of their inner radii, increased by the thickness d of a partition wall provided between the pockets 19. In the other row, the axes 24 of the pockets for the smaller drills are arranged at equal distances, the axes of the pockets for the largest and the smallest drills and the axes of the pockets for the drills with the nominal diameters of 6.5 and 6 mm, respectively, being arranged side by side. In addition, a cover plate 151 is slidably guided on the selector element 133' for displacement in the transverse direction marked by the arrow 150 in FIG. 12. This plate serves to alternatively close the selector opening 136', for the smaller drills or the selector opening 134' for the larger drills.

In order to permit the introduction of the selector element 133' into the U-shaped guiding grooves defined by the guide ribs 139 and 140 and the lateral flanges 141 and 142 facing each other, at least one of the guide ribs 139 or 140 should be part of a plate detachably mounted to the magazine body 11. Such a design of the magazine 10 facilitates not only the assembly of the magazine 10 but also the easy exchange of the covering strip 137, 138, and/or its selector element 133, if such exchange should become necessary.

If the magazine body 11 is to be produced by die-casting, it is also advantageous to assemble the body from prefabricated parts that can be bonded or welded together along the planes of axes 26 and 27, so that the pockets 19 and 20 are delimited by oppositely arranged grooves in the assembled, substantially plate-shaped partial bodies 152/153 and 153/154, respectively. This helps in a decisive manner to simplify the production of suitable die-casting moulds.

What we claim is:

1. A magazine for a protected storage of a set of drills and for a selective withdrawal of the drills arranged in individual pockets in the magazine, the magazine including a covering means having at least one opening movable into positions suitable for giving access to one drill at a time, by guiding displacement of the covering means, characterized in that the magazine includes a flat cuboid magazine body having narrow end faces and comprising at least two straight rows of parallel pockets with drills inserted therein over their full length, the pockets have one open end opening in a direction of one the narrow end face of the magazine body;

the covering means includes at least one covering strip; the narrow end faces of the magazine body are interconnected by 90° curved transition faces and form a sliding face for the covering strip which is slidably guided along a narrow surface area of the magazine body formed by the narrow end faces and the curved transition faces; the covering strip comprises a number of selector openings corresponding to the number rows of pockets, the covering strip is displaceable and can be alternatively brought into a position giving access to the open end of a selected pocket in one row so that the selected drill can be removed therefrom, a diameter of the selector openings associated with the two rows of pockets being at least equal to a diameter of the largest drill in the respective row, and a center distance of the pockets, measured in a direction of displacement, of the covering strip, being at least equal to a clear width of the selector opening.

2. A magazine in accordance with claim 1, characterized in that the selector openings which can be moved across one each of the two rows are arranged at a distance, from each other as viewed in a longitudinal direction of the selector strip, which is a little greater than a length of one of the two rows of pockets, measured in the direction of displacement of the strip.

3. A magazine in accordance with claim 2, characterized in that the magazine body is formed of two magazine pieces with a separating face forming a plane extending between the two rows of pockets, the pockets are formed as grooves in faces of the two magazine pieces facing each other the grooves are separated by a partition wall inserted between the two magazine pieces, and in that positively engaging detent means are provided for assembling the two magazine pieces.

4. A magazine in accordance with claim 3, characterized in that an inner cross-section of the grooves in the two magazine pieces has a U-shape and a depth of the grooves, measured in a perpendicular direction to the separating face as well as a clear width, measured in the direction of displacement of the selector opening, are only very little larger than a nominal diameter of the drill to be stored therein.

5. A magazine in accordance with one of claims 3 or 4, characterized in that the two magazine pieces of the magazine comprising the grooves are made of a colorless transparent material, and in that the partition wall consists of one of an opaque film or plate inserted between the two magazine pieces of a color contrasting to that of the drills.

6. A magazine in accordance with claim 5, characterized in that one of guide beads or ribs project from edges of the sliding face, the guide beads or ribs have a height, as measured from the sliding face, at least at the narrow face of the magazine body opposite the pocket openings which is a little greater than a greatest thickness of the covering strip.

7. A magazine in accordance with claim 2, characterized in that the magazine body a one-piece plate-shaped center part having narrow end faces forming the sliding face for the covering strip, the center part is provided at opposite outer sides thereof with recessed grooves forming the pockets, flat plates are fastened to the outer sides of the center part closing off the grooves the flat plates include edges projecting beyond the sliding face so as to form lateral guide ribs for the covering strip.

8. A magazine in accordance with claims 6, characterized in that the covering strip is a flexible plastic strip provided with reinforced grip ribs extending crosswise to the direction of displacement of the covering strip, and narrow film joints are arranged in that imparting flexibility to the strip, whereas the other side of the covering strip facing the sliding face is completely level.

9. A magazine in accordance with claim 8, characterized in that the covering strip is provided on both sides of the selector openings with raised grip beads extending crosswise to a longitudinal direction of the covering strip.

10. A magazine in accordance with claim 9, characterized in that at one of the narrow end faces of the magazine body extending vertically to the narrow end face provided with the pocket openings the height of the guide beads or ribs is noticeably reduced as compared to a maximum width of the covering strip in an area of a length of approximately 5 to 8 cm.

11. A magazine in accordance with claim 10, characterized in that the covering strip is a closed strip and includes at least one portion is sufficiently elastic to permit the application of the covering strip to the sliding face.

12. A magazine in accordance with claim 11, characterized in that the covering strip is applied to the sliding face under a certain, very little, elastic tension.

13. A magazine in accordance with claim 1, characterized in that the covering strip is a folding strip divided into two strands, the folding strip has a length which can be reduced or extended, similar to that of a bellows by a maximum total displacement required for the selector openings, the selector openings are provided in a selector element, the covering strip includes two strands with the selector element arranged between the two strands, ends of the strands opposite the selector element are fixed to opposite narrow end faces of the magazine body extending vertically to the end face provided with the pocket openings.

14. A magazine in accordance with claim 13, characterized in that the strands of the covering strip and the selector element are guided between guide ribs extending along both sides of the end faces of the magazine body, the guide ribs are provided with end flanges embracing edges of the strands, and in that a clearance distance between the end flanges and the respective end face of the magazine body is at least equal to a maximum depth of folds of the covering strip.

15. A magazine in accordance with claim 13 or 14, characterized in that the covering strip consists of a springy material of wave-like structure with parallel wave crests and troughs extending crosswise to its longitudinal direction.

16. A magazine in accordance with claim 14 or 15, characterized in that the folding strip used as covering strip comprises a periodic sequence of crosswise extending strips of increased stiffness and film joints interconnecting the latter.

17. A magazine in accordance with claim 16, characterized in that the film joints are marked by crosswise extending grooves in the covering strip opening alternately towards the outside and towards the sliding face.

18. A magazine in accordance with claim 17, characterized in that the axes of the two rows of pockets extend in two parallel longitudinal planes of the magazine body, one row of pockets comprising the pockets for the larger drills and the other row of pockets comprising the pockets for the smaller drills and the axes of the pockets of both rows being arranged at equal distances, as viewed in the longitudinal direction of the magazine body in the direction of displacement of the selector element, a distance between the planes of the axes is at least equal to a diameter of a largest one of the pockets, that the axes of the pockets for the smaller drills are staggered in relation to the axes of the pockets for the larger drills, viewed in the longitudinal direction of the magazine body, the selector element is symmetrical in relation to its center plane extending vertically to the planes of the axes, and in that the selector openings in the selector element have a outline corresponding to a contour of two circles centers of which are arranged in one each of the two planes of the axes and diameters of which are at least equal to, or a little greater than that of the largest pocket in a respective row.

19. A magazine in accordance with one of claim 13 or 14,, characterized in that the axes of two rows of pockets extend in two parallel planes, one of the rows of the pockets accommodate a group of drills having nominal diameters which exceed a certain minimum value, and the other of the rows of pockets accommodate drills with smaller nominal diameters such that, viewed in the same direction, the diameters of the one row of pockets are arranged in increasing order and the diameters of the other row of pockets are arranged in decreading order, a distance between neighboring pockets is equal to the largest pocket diameter when a sum of their radii is smaller thant approximately 70% of the diameter of the largest pocket in the respective row, the distance between neighboring pockets is equal to a sum of their radii increased by a constant value the amount of which corresponds to the minimum thickness of a partition wall between the pockets, when the sum of their radii is in excess of approximately 70% of the largest pocket diameter in the respective row, and in that a cover plate is slidably arranged on the selector element, which can be displaced the cover plate is displaceable in a direction vertical to the direction of displacement of the selector element and serves to alternatively cover at least a central portion of the openings arranged along the one end along the other pocket row.

20. A magazine in accordance with one of claims 13 or 14 for a set of drills in sizes of between 1 and 10 mm, graded by 0.5 mm steps, characterized in that eleven pockets are provided in one of rows for accommodating eleven drills, with of nominal diameters of between 1 and 6 mm, eight pockets are provided in the other row of pockets for accommodating eight drills with nominal diameters of between 6.5 and 10 mm, a distance between the planes of the axes of the rows of pockets is approximately 8 mm, a minimum thickness of a partition wall between the pockets is approximately 2 mm, as measured along the planes of the axes, and in that central axes of the largest and the smallest pockets are arranged adjacent each other in a cross-plane extending vertically to the planes of the axes.

21. A magazine in accordance with claim 4, characterized in that the depth and clear width are in the range of approximately 0.2 to 0.5 mm.

22. A magazine in accordance with one of claims 1, 2, or 7, characterized in that one of guide beads or ribs project from edges of the sliding face, the guide beads or ribs have a height, as measured from the sliding face, at least at the narrow face of the magazine body opposite the pocket openings which is a little greater than a greatest thickness of the covering strip.

23. A magazine in accordance with one of claims 1, 2, or 3, characterized in that the covering strip is a flexible plastic strip provided with reinforced grip ribs extending crosswise to the direction of displacement of the covering strip, and in that narrow film joints are arranged between the grip ribs for imparting flexibility to the covering strip, whereas the other side of the covering strip facing the sliding surface is completely level.

24. A magazine according to claim 23, characterized in that the covering strip is provided on both sides of the selector openings with raised grip beads extending crosswise to a longitudinal direction of the covering strip.

* * * * *